US007783177B2

(12) United States Patent
Ikesaki

(10) Patent No.: US 7,783,177 B2
(45) Date of Patent: Aug. 24, 2010

(54) MANUAL ELECTRICAL EQUIPMENT FOR HAIR STRAIGHTENING

(75) Inventor: Roberto Jun Ikesaki, São Paulo (BR)

(73) Assignee: Daihatsu Industria e Comercio de Moveis e Aparelhos Eletricos Ltda (ES)

( * ) Notice: Subject to any disclaimer, the term of this patent is extended or adjusted under 35 U.S.C. 154(b) by 912 days.

(21) Appl. No.: 10/569,777

(22) PCT Filed: Sep. 3, 2004

(86) PCT No.: PCT/BR2004/000165

§ 371 (c)(1),
(2), (4) Date: Dec. 22, 2006

(87) PCT Pub. No.: WO2005/023046

PCT Pub. Date: Mar. 17, 2005

(65) Prior Publication Data

US 2007/0163614 A1 Jul. 19, 2007

(30) Foreign Application Priority Data

Sep. 5, 2003 (BR) ..... 0303797
Aug. 26, 2004 (BR) ..... 0303797

(51) Int. Cl.
*A47J 27/00* (2006.01)
*A45D 1/04* (2006.01)

(52) U.S. Cl. ..... 392/380; 132/229

(58) Field of Classification Search ..... 392/379–385; 132/224–269; 34/96–101, 282–283
See application file for complete search history.

(56) References Cited

U.S. PATENT DOCUMENTS

| | | | | |
|---|---|---|---|---|
| 4,365,140 | A * | 12/1982 | Bast et al. | 219/225 |
| 4,841,127 | A | 6/1989 | Prager et al. | |
| 6,973,931 | B1 * | 12/2005 | King | 132/212 |
| 2006/0150996 | A1 * | 7/2006 | Lun et al. | 132/224 |
| 2006/0201527 | A1 * | 9/2006 | Higgins et al. | 132/225 |
| 2006/0254073 | A1 * | 11/2006 | Zhen | 34/96 |
| 2007/0277843 | A1 * | 12/2007 | Whitman | 132/238 |

FOREIGN PATENT DOCUMENTS

| | | |
|---|---|---|
| FR | 2352512 | 12/1977 |
| JP | 2001/137038 | * 12/1899 |
| JP | 58092307 | 6/1983 |
| JP | 2001-137038 | 5/2001 |
| WO | WO 03/056971 | 7/2003 |

OTHER PUBLICATIONS

International Search Report; PCT/BR2004/000165; 27 Dec. 2004.

* cited by examiner

*Primary Examiner*—Daniel Robinson
(74) *Attorney, Agent, or Firm*—Cantor Colburn LLP

(57) ABSTRACT

"MANUAL ELECTRICAL EQUIPMENT FOR HAIR STRAIGHTENING", wherein each one of the heating plates of the referred equipment has a respective resistance, wherein the equipment characterized by the fact that each one of the resistances is controlled by a thermostat with differentiated temperature; in an alternative variant, the equipment incorporates in substitution of electrical resistances, PTC type thermistors.

3 Claims, 6 Drawing Sheets

MANUAL ELECTRICAL EQUIPMENT FOR HAIR STRAIGHTENING

TECHNICAL FIELD OF THE INVENTION

The present report deals with an Invention Privilege patent with regard to an improvement introduced in a manual electrical equipment for hair straightening, which presents a constructivity that renders its use more efficient.

DESCRIPTION OF THE RELATED ART

As it is of common knowledge, equipment of this type that are dealt with here and that are popularly known as "hair straightening flat iron", are electrical equipments for manual use and are composed of two heated aluminum plates, where the temperature control of said plates is regulated by a thermostat or through adequate electronic devices.

The working principle of said "hair straightening flat iron" is based on the heating of hair strands at the same time that these are slightly pressed between the aluminum plates of the equipment.

Under such condition, the hairs acquire the temperature of the aluminum and are straightened as they pass through two smooth and heated surfaces.

Generally, the equipment presently used offers just one temperature, since the two electrical resistances that heat each of the two aluminum plates are electrically assembled so that they establish contact directly with the electrical network.

In this type of constructivity, the final temperature of the aluminum plates are determined by the thermostat that regulates, through connect/disconnect cycles, the electrical resistances in function of the temperature.

Another equipment model is also known, normally of foreign origin, where a range of regulable temperatures is offered, in which such genre of equipment uses a sensor mounted on the aluminum and a complex electronic control circuit, which is connected to the referred sensor, allows the set point of the apparatus to be chosen between 80 and 200 degrees Centigrade of temperature for the aluminum plates.

In this type of equipment, which presents an elevated production and commercialization cost, it is possible to choose the temperature between 80 and 200 degrees Centigrade without defined positions.

BRIEF SUMMARY OF THE INVENTION

Considering the prior art, it is characterized as being one of the objectives of this invention privilege patent, which is to provide an improvement introduced in a manual electrical equipment applied to produce the straightening of hairs, where the improvement itself lies in promoting the commutation of temperature through a "H-H" type key, where it is possible to choose two distinct positions of operation, that is, one of "low temperature" with the thermostat of one of the sides (one of the aluminum plates) that controls the operation of the two resistances and, another position of "high temperature", where it can be chosen that the thermostat of the other side (of the other aluminum plate) may control the operation of the two resistances.

Another innovating aspect of the present patent lies in the possibility that the equipment in question functions with two different temperatures in a condition, according to which the commutation between the thermostat and the light indicator of the chosen temperature level may be done concomitantly.

Another innovating characteristic of the present patent is also to provide a change in the equipment in question where PTC (Positive Temperature Coefficient) technology is applied, which permits the substitution of the electrical resistances by ceramic components also known as thermistors.

BRIEF DESCRIPTION OF THE DRAWINGS

Now, the invention privilege patent dealt with will be described in detail with reference to the figures listed below, in which.

DETAILED DESCRIPTION OF THE INVENTION

In accordance with what the abovementioned figures illustrate, the manual electrical equipment for hair straightening, which is object of this invention privilege patent, allows that each one of the heating plates (1) has its respective resistance (2) controlled by a thermostat (3) with differentiated temperature, where, for example, a thermostat can be provided with a temperature of 180° C. and another with 150° C., such that the choice of the desired temperature is indicated by a corresponding LED (4).

Figure 1:
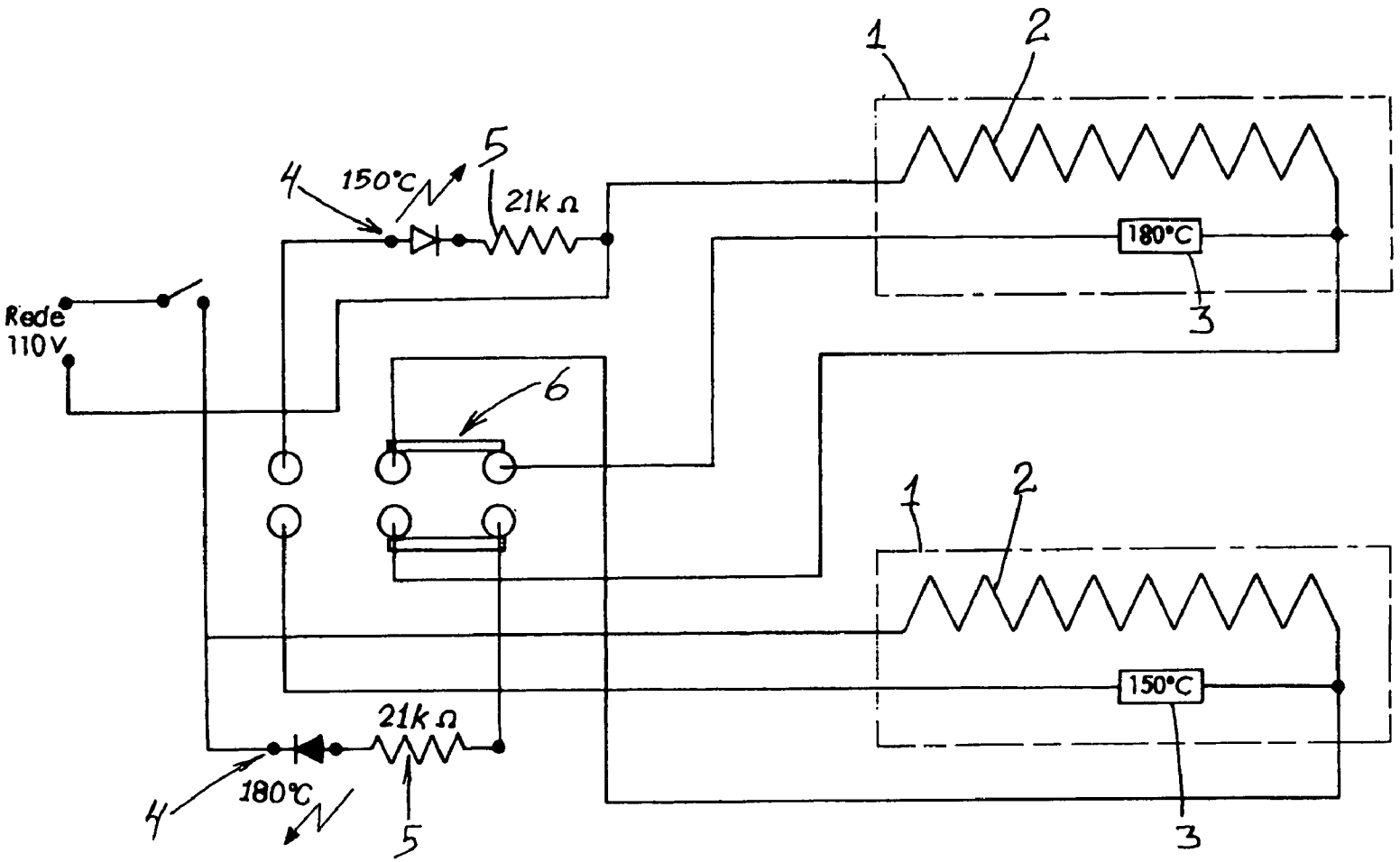
FIG. 1 illustrates an electrical diagram of the iron presently dealt with in a version destined for use with a power supply input of 110V.
Figure 2:
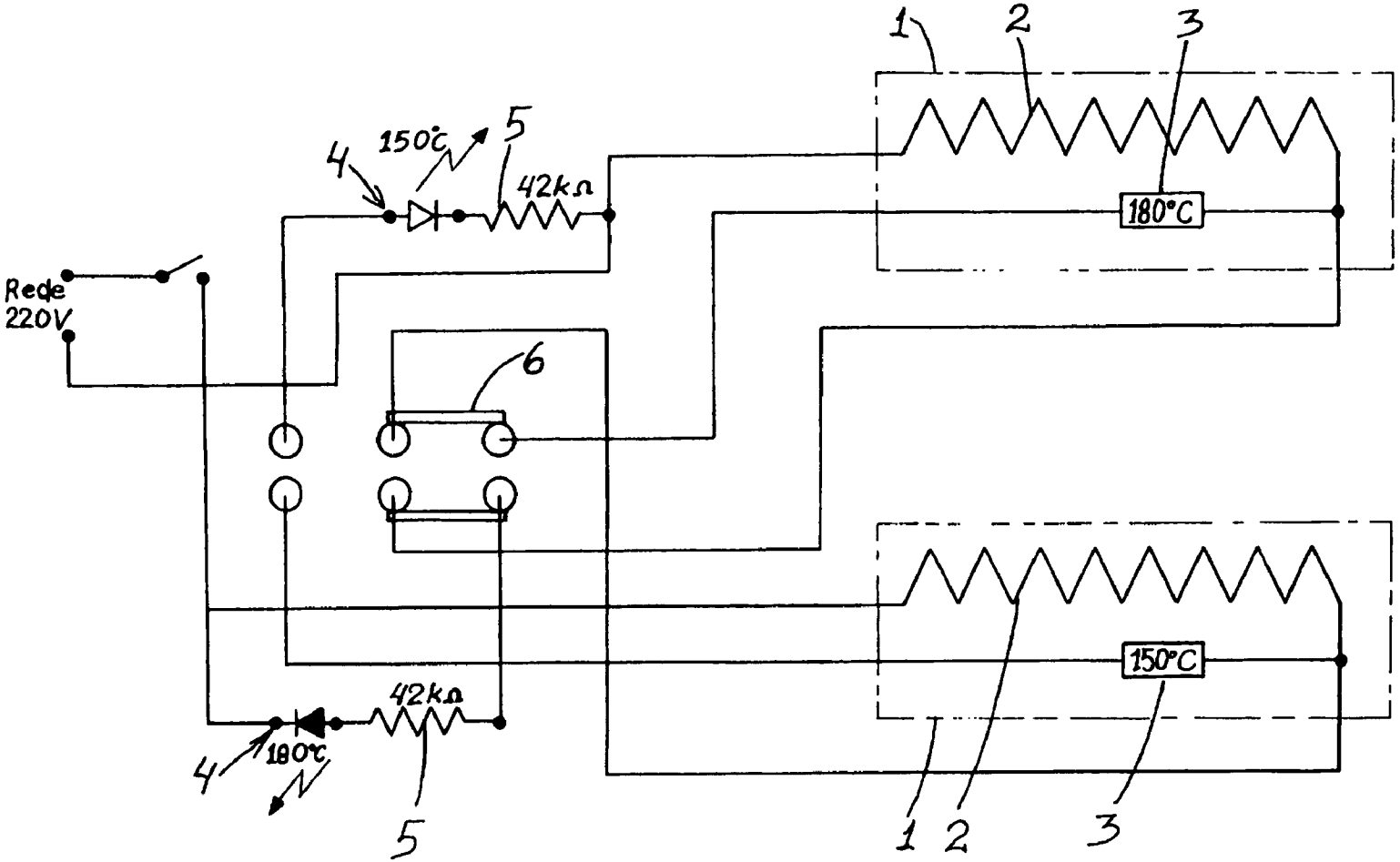
FIG. 2 illustrates an electrical diagram of the iron described herewith, where a version destined for use is presented with a power supply input of 220V.

The selected temperature is indicated through the respective LED's (4), such that one of them counts with a resistance of 5 to 21 k (FIG. 1) at 110V and 42 k at 220V (FIG. 2).

The commutation between two temperatures that the equipment will be introducing is obtained through the application of the "H-H" key 6, which, in the first two figures that illustrates the present patent (FIGS. 1 and 2), is found in the position that corresponds to the temperature of 180° C.

Now, the equipment being dealt with, when confronted with similar equipments from prior art presents a constructivity substantially simpler and more functional, discarding components with elevated cost, such as SRC integrated circuits, capacitors, resistors, etc.

The cited temperature values, that is, of 150 and 180 degrees centigrade are also values that can be altered in function of design and according to the application that the equipment will have. Thus, other temperature values can be used, such as, for example, 140° C. for straight hair and 190° C. for frizzy or curly hair.

FIGS. 3, 4, 5 and 6 illustrate a variant of the equipment being dealt with, where each of the heating plates (1), instead of the electrical resistances (2) counts on a respective thermistor (7).

The thermistors (7) operate under the PTC (Positive Temperature Coefficient) principle, which is constituted as a ceramic component whose resistivity grows rapidly when a certain temperature is exceeded.

Such characteristic causes said component to heat up its respective aluminum plate 1 of the hair straightening flat iron up to an established temperature, such that in reaching such temperature an auto-regulation of the attained value occurs.

The application of the thermistors (7) allows that the heat lost from the iron to the hairs at the moment of straightening may be rapidly reestablished, thus maintaining the equipment's performance.

A typical PTC thermistor comprises a ceramic tablet that receives the metallization in its opposite faces, where the working voltage is applied by means of thin aluminum plates connected to the electric power supply.

Another characteristic of the PTC thermistor is the fact that it presents the same temperature value (temperature stabilization) for voltages of 110V, as well as for 220V, which makes it naturally an automatic bi-volt device.

In the proposed solution in the present variant, the thermistors (7) are used with three terminals, which are indicated as T1, T2 and T3.

Figure 4:
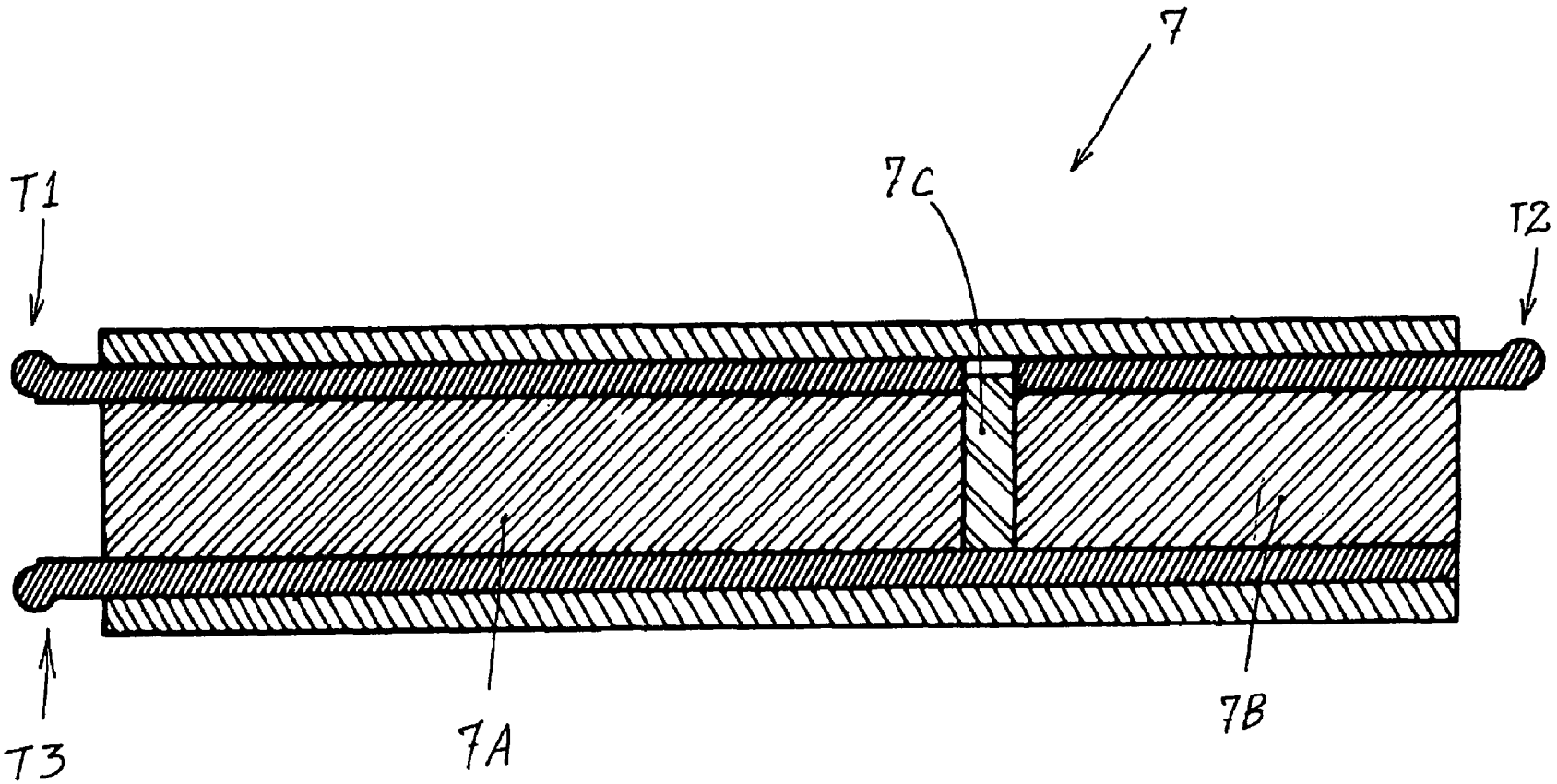
FIG. 4 illustrates a schematic view of one of the PTC components used in the equipment with regard to the variant in question.
Figure 5:
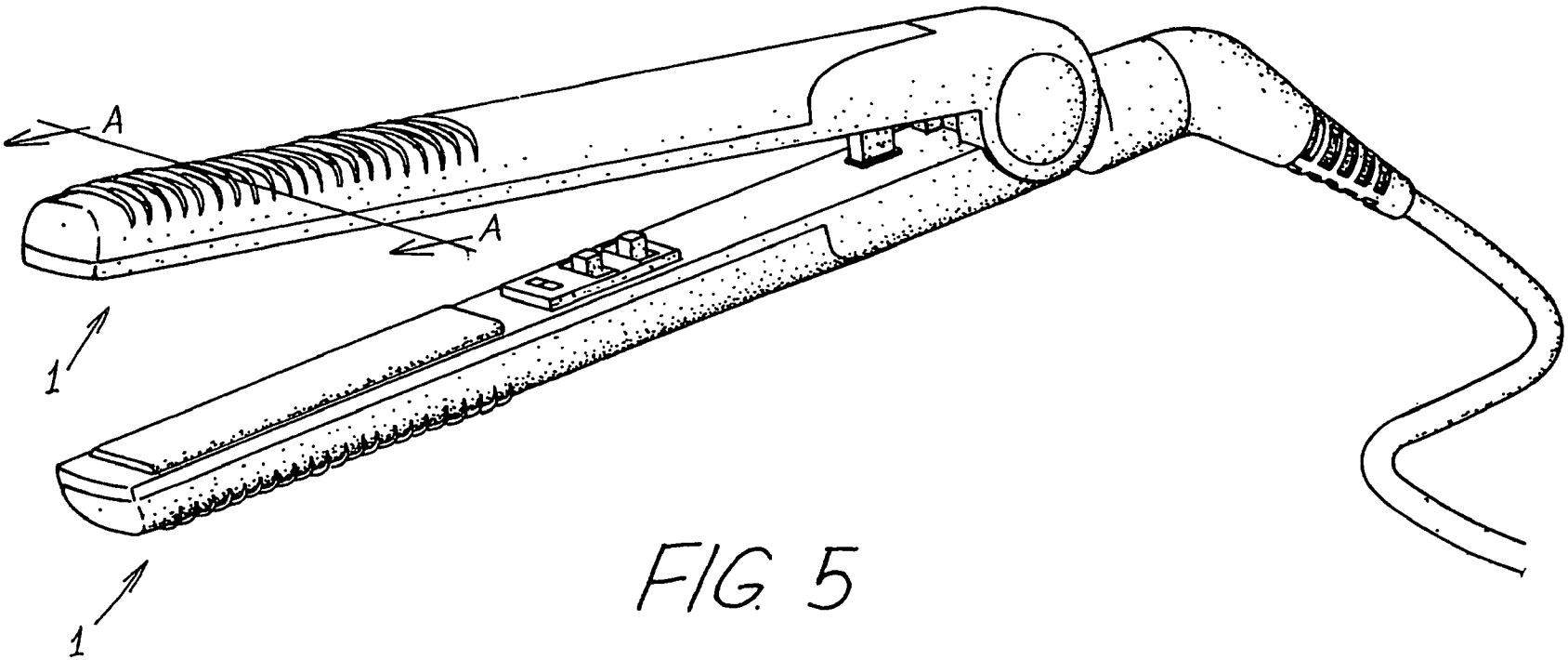
FIG. 5 illustrates a view of the equipment in its finalized form.
Figure 6:
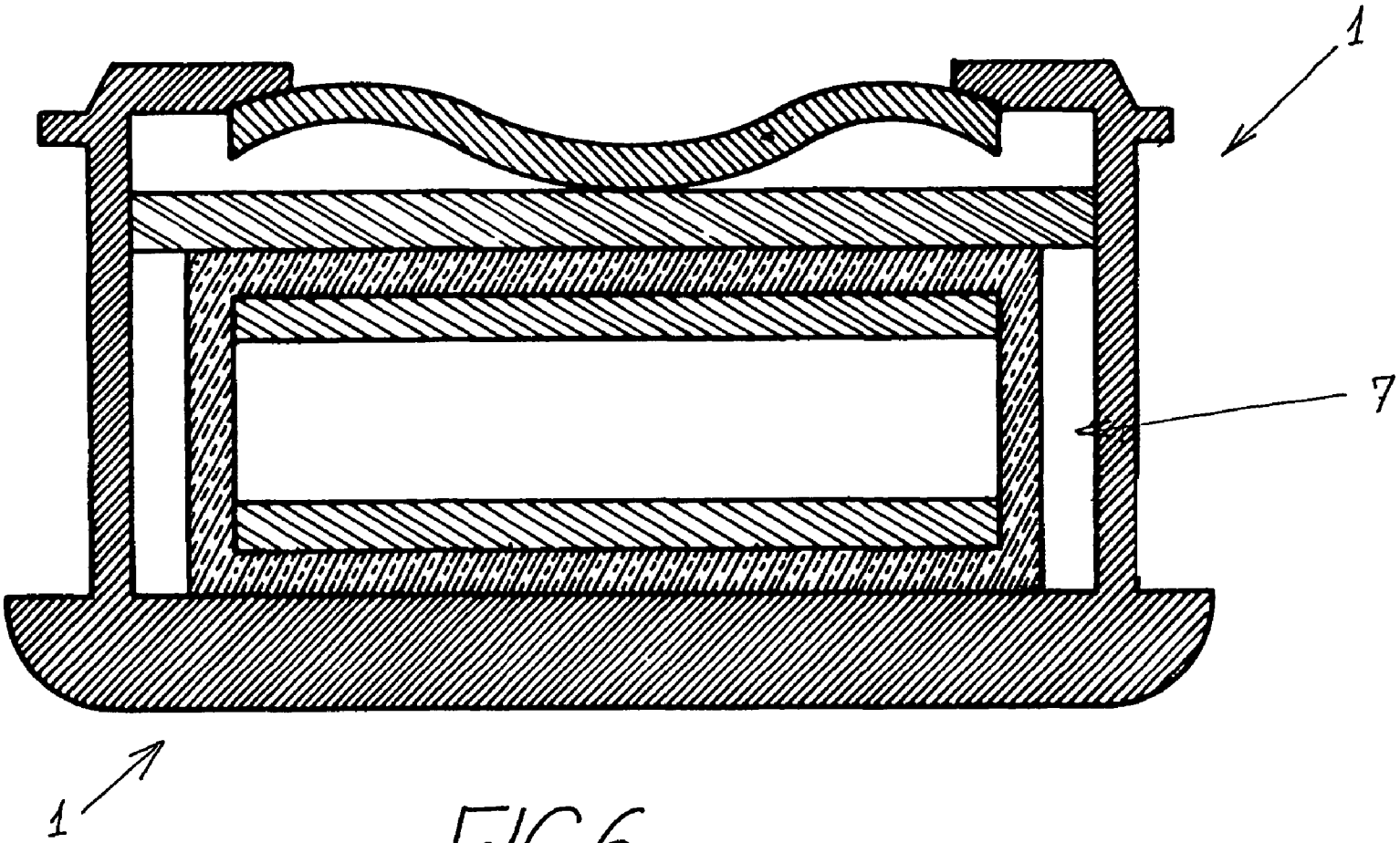
FIG. 6 illustrates a schematic section taken from FIG. 2, such as indicated by the A-A section line.

In addition to the provision of three terminals, the thermistors (7) of the equipment in question includes, each one, two sections, where one is larger (7A) and the other smaller (7B), in which both are separated by an insulation (7C), such as the one that can be better observed in FIG. 4.

Through the commutation performed by means of the "H-H" key (6), it is possible to obtain, alternatively, the engagement of the smaller section (7B), or of the larger section (7A).

The division of the thermistor (7) in two sections of different sizes allows that the generated heat potential may be the function of the section that is in operation, since, with the "H-H" key (6) commuting the larger section (7A), 190° C., for example, is obtained, while when the referred key is commuted to activate section (7B) the temperature obtained is around 150° C.

The abovementioned temperature values can be altered depending on the application of the product, wherein such alteration of value is obtained through the modification in the size of the two sections.

Figure 3:
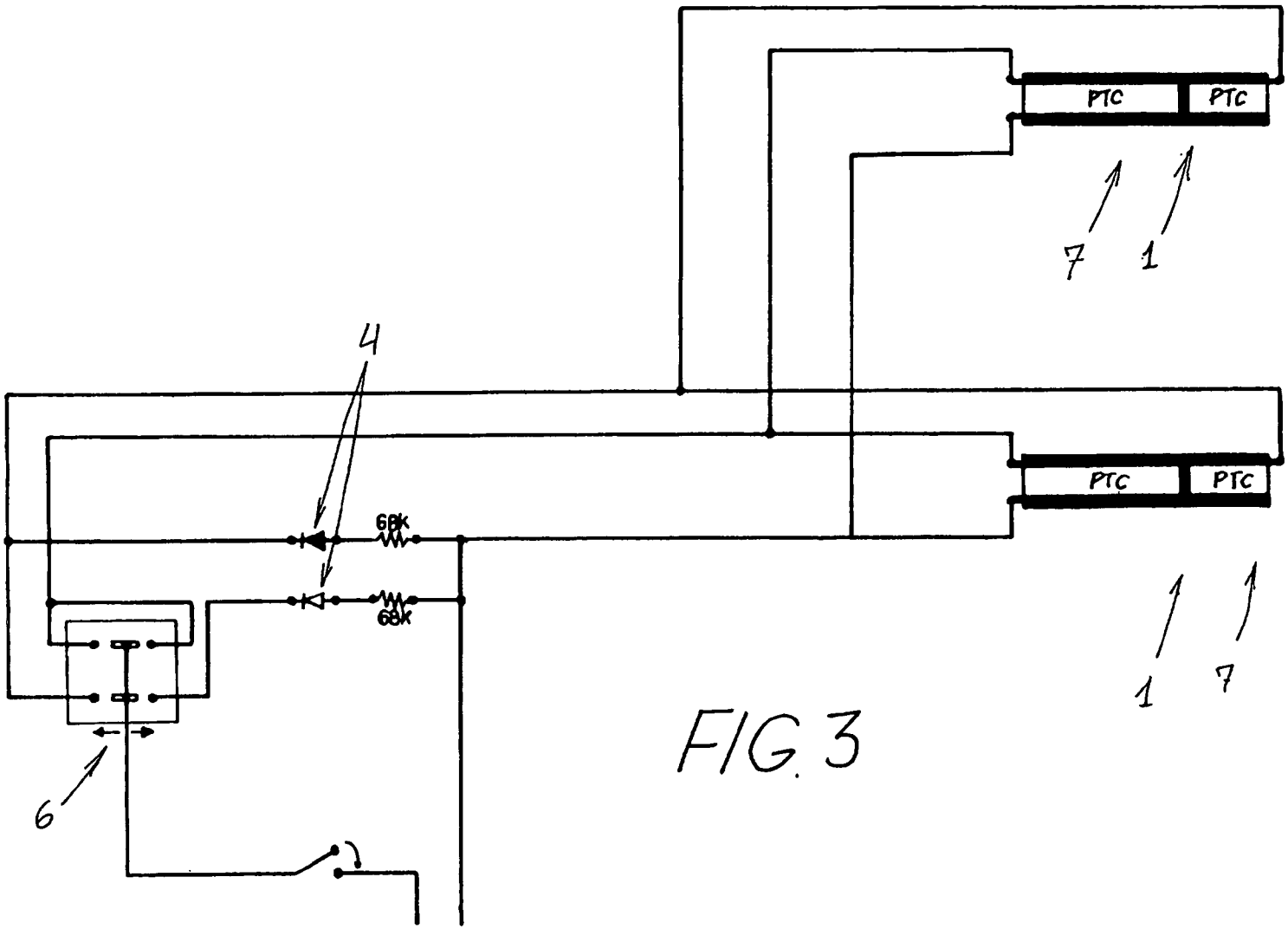
FIG. 3 illustrates an electrical diagram of a variant in the equipment presently dealt with, wherein that change is represented by the application of the cited PTC technology in the substitution of the electrical resistances.

As can be better understood from the observation of FIG. 3, the "H-H" key (6) also performs and in a simultaneous manner, the commutation between the LED's (4) that indicate the two temperature levels, that is, on its operation, the "H-H" key (6) is far from determining with its positioning which section of each one of the thermistors (7) is in operation (which temperature is being selected), also selects the LED (4) corresponding to the temperature that is being selected.

From the point of view of the equipment in question, a color coding for the LED's (4) can be adopted so as to indicate to the user which temperature is selected, being able to adopt preferentially, for example, a yellow LED (4) for the lower temperature value and a red LED (4) for the higher temperature value.

The invention claimed is:

1. "MANUAL ELECTRICAL EQUIPMENT FOR HAIR STRAIGHTENING", comprising heating plates wherein each one of the heating plates has a respective thermistor; the thermistors operate under a PTC (Positive Temperature Coefficient) principle, wherein these are constituted as a ceramic component whose resistivity grows rapidly when a certain temperature is exceeded; the thermistors are used with three terminals, and; aside from the provision of three terminals, the thermistors of the equipment in question include, each one, two sections, wherein one is larger and the other smaller, both being separated by an insulation; the equipment has an "H-H" key, through commutation from which is possible to obtain, alternatively, the engagement of the smaller section, or of larger section; the "H-H" key performs, in a simultaneous manner, the commutation between LED's that indicate the two temperature levels.

2. "MANUAL ELECTRICAL EQUIPMENT FOR HAIR STRAIGHTENING", according to claim 1, wherein the division of the thermistor in two sections of different sizes allows that the generated heat potential may be in function of the section that is in operation.

3. "MANUAL ELECTRICAL EQUIPMENT FOR HAIR STRAIGHTENING", according to claim 1, wherein the equipment in question is bi-volt.

* * * * *